US008714689B2

(12) United States Patent
Abe

(10) Patent No.: US 8,714,689 B2
(45) Date of Patent: May 6, 2014

(54) IMAGE FORMING APPARATUS AND DEFECTIVE NOZZLE DETECTING METHOD

(75) Inventor: Kimito Abe, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 330 days.

(21) Appl. No.: 13/305,214

(22) Filed: Nov. 28, 2011

(65) Prior Publication Data

US 2012/0139982 A1 Jun. 7, 2012

(30) Foreign Application Priority Data

Dec. 3, 2010 (JP) ..... 2010-270330

(51) Int. Cl.
*B41J 29/393* (2006.01)
*B41J 2/045* (2006.01)
*B41J 2/21* (2006.01)

(52) U.S. Cl.
CPC ..... *B41J 2/04561* (2013.01); *B41J 2/0451* (2013.01); *B41J 2/2142* (2013.01)
USPC ..... 347/19; 347/23

(58) Field of Classification Search
CPC ..... B41J 2/04561; B41J 2/0451; B41J 2/2142
USPC ..... 347/19
See application file for complete search history.

(56) References Cited

FOREIGN PATENT DOCUMENTS

| | | | | |
|---|---|---|---|---|
| JP | 2007-015193 A | | 1/2007 | |
| JP | 3991279 B2 | | 8/2007 | |
| JP | 2009-078539 A | | 4/2009 | |
| JP | 2009-132025 A | | 6/2009 | |
| JP | 2010-18022 | * | 1/2010 | ..... 347/19 |

OTHER PUBLICATIONS

English language abstract for JP-2005-219486 which corresponds to JP-3991279-B2.

* cited by examiner

*Primary Examiner* — Julian Huffman
(74) *Attorney, Agent, or Firm* — Harness, Dickey, & Pierce, P.L.C.

(57) ABSTRACT

An image forming apparatus that forms an image on a recording sheet by discharging ink droplets from nozzles provided in a print head on the recording sheet includes: a light emitting unit that generates detection light intersecting a discharge path of the ink droplets; a discharge signal output unit that outputs a discharge signal used to discharge the ink droplets from a detection target nozzle; a first light receiving unit that receives scattered light generated by irradiating the ink droplets with the detection light and outputs a first detection signal; a second light receiving unit that receives the detection light having passed through the discharge path of the ink droplets without irradiating the ink droplets and outputs a second detection signal; a determination unit that determines whether the detection target nozzle is a defective nozzle; and a correction unit that corrects a determination result of the determination unit.

7 Claims, 12 Drawing Sheets

IMAGE FORMING APPARATUS AND DEFECTIVE NOZZLE DETECTING METHOD

CROSS-REFERENCE TO RELATED APPLICATIONS

The present application claims priority to and incorporates by reference the entire contents of Japanese Patent Application No. 2010-270330 filed in Japan on Dec. 3, 2010.

BACKGROUND OF THE INVENTION

1. Field of the Invention

The present invention relates to an image forming apparatus that forms an image on a recording sheet by discharging ink droplets from nozzles and a method of detecting a defective nozzle that cannot discharge ink droplets.

2. Description of the Related Art

An ink jet printer, as one type of an image forming apparatus, includes a print head in which a plurality of nozzles are arranged and forms an image on a recording sheet by discharging ink droplets on the surface of the recording sheet from nozzles provided in the print head. There are cases where it is difficult for the ink jet printer to discharge ink droplets due to the clogging of some of the nozzles caused by an increased viscosity of the ink, mixing-in of air bubbles, attachment of dust or paper powders, or the like.

In a case where there is a defective nozzle that cannot discharge ink droplets and the formation of an image is continued in such a state, the image quality markedly deteriorates. Accordingly, it is preferable to promptly detect a defective nozzle and perform a countermeasure such as a cleaning process quickly. In particular, a line-type ink jet printer in which a plurality of print heads are arranged in the main-scanning direction has a high printing speed, and accordingly, considerable damage occurs if a late countermeasure is taken after the occurrence of a defective nozzle.

From this viewpoint, in the field of ink jet printers, various technologies have been proposed for detecting a defective nozzle. For example, as disclosed in Japanese Patent Application Laid-open No. 2009-132025, there is a known technology which employs a light emitting element that emits detection light in a direction intersecting the discharge direction of ink droplets and a light receiving element that receives scattered light generated by irradiating the ink droplets discharged from nozzles with the detection light. According to the technology, a defective nozzle is detected by determining the discharged state of the ink liquid based on the output of the light receiving element.

In addition, as technologies for detecting a defective nozzle during an operation of forming an image on a recording sheet (during a printing operation), there are known exemplary technologies such as the technologies disclosed in Japanese Patent Application Laid-open No. 2007-15193 and Japanese Patent No. 3991279.

According to the technology disclosed in Japanese Patent Application Laid-open No. 2007-15193, a sensor detects an end of a recording sheet is used to determine a space, in which a recording sheet is not present, between two recording sheets which are sequentially conveyed during a printing operation, and a defective nozzle is optically detected by sequentially discharging ink droplets from each nozzle every time the space is encountered.

In addition, according to the technology disclosed in Japanese Patent No. 3991279, a defective nozzle can be optically detected during a printing operation by adjusting the timing to discharge an ink droplet from a nozzle that is a detection target to be earlier or later than the timing to discharge an ink droplet from another nozzle.

However, in a case where a defective nozzle is optically detected during a printing operation, the detection light emitted from a light emitting element is likely to be blocked due to the floating of a conveying belt that conveys a recording sheet or the floating of a recording sheet placed on the conveying belt to make it difficult to appropriately detect a defective nozzle. Particularly in a line-type ink jet printer, during a printing operation, a print head is fixed to a position which faces, with a gap of about 1 mm therebetween, the conveying belt that revolves at a high speed. Accordingly, even when a slight floating of the conveying belt or the recording sheet occurs, the detection light used for detecting a defective nozzle is blocked, and thus it is difficult to perform an appropriate detection.

In the line-type ink jet printer, although various technologies for suppressing the floating of the conveying belt have been proposed, it is difficult to completely eliminate the floating of the conveying belt. Accordingly, the detection light is likely to be temporarily blocked due to the unexpected floating of the conveying belt or the recording sheet. Thus, in a conventional technology, it is difficult to determine the cause of the decrease of the detection light when the light is blocked by the floating of the conveying belt or the floating of a recording sheet. Accordingly, an event in which an output of a light receiving element decreases due to the floating of the conveying belt or the floating of the recording sheet is determined that an ink droplet is not discharged. Thus, there has been a problem in that the accuracy of detection of a defective nozzle decreases.

SUMMARY OF THE INVENTION

It is an object of the present invention to at least partially solve the problems in the conventional technology.

An image forming apparatus forms an image on a recording sheet conveyed by a conveying unit by discharging ink droplets from nozzles provided in a print head on the recording sheet. The image forming apparatus includes: a light emitting unit that generates detection light intersecting a discharge path of the ink droplets; a discharge signal output unit that outputs a discharge signal used to discharge the ink droplets from a detection target nozzle that is a target for detecting a defective nozzle from among the nozzles; a first light receiving unit that receives scattered light generated by irradiating the ink droplets with the detection light and outputs a first detection signal in proportion to an amount of the received light; a second light receiving unit that receives the detection light passing through the discharge path of the ink droplets without irradiating the ink droplets and outputs a second detection signal in proportion to an amount of the received light; a determination unit that determines whether or not the detection target nozzle is a defective nozzle incapable of discharging ink droplets based on the first detection signal output from the first light receiving unit when the discharge signal is output from the discharge signal output unit; and a correction unit that corrects a determination result of the determination unit based on the second detection signal output from the second light receiving unit.

A defective nozzle detecting method is executed in an image forming apparatus that forms an image on a recording sheet conveyed by a conveying unit by discharging ink droplets from nozzles provided in a print head to the recording sheet. The defective nozzle detecting method includes: generating, by using a light emitting unit of the image forming apparatus, detection light that intersects a discharge path of the ink droplets; outputting, from a discharge signal output unit of the image forming apparatus, a discharge signal used to discharge the ink droplets from a detection target nozzle being a target for detecting a defective nozzle from among the nozzles; outputting, when the first receiving unit receives scattered light generated by irradiating the ink droplets with the detection light, a first detection signal, from a first receiving unit of the image forming apparatus, in proportion to an amount of the received light; outputting, when the second light receiving unit receives the detection light passing through the discharge path of the ink droplets without irradiating the ink droplets, a second detection signal, from a second light receiving unit of the image forming apparatus, in proportion to an amount of the received light; determining, by a determination unit of the image forming apparatus, whether or not the detection target nozzle is a defective nozzle incapable of discharging the ink droplets based on the first detection signal output from the first light receiving unit when the discharge signal is output from the discharge signal output unit; and correcting, by a correction unit of the image forming apparatus, a determination result of the determination unit based on the second detection signal output from the second light receiving unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an image forming apparatus and a defective nozzle detecting method according to an embodiment will be described in detail with reference to the accompanying drawings.

Figure 1:
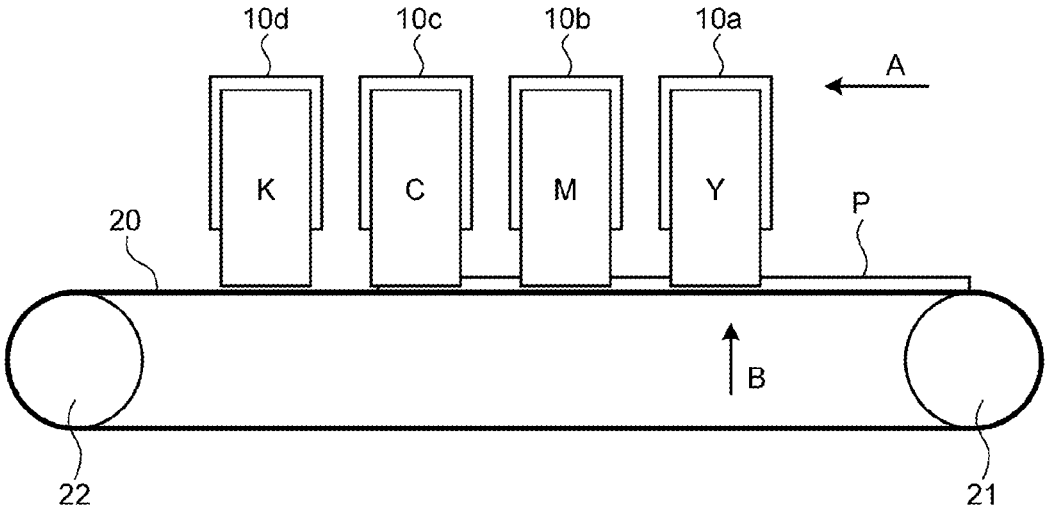
FIG. 1 is a side view of an image forming apparatus according to an embodiment.
Figure 2:
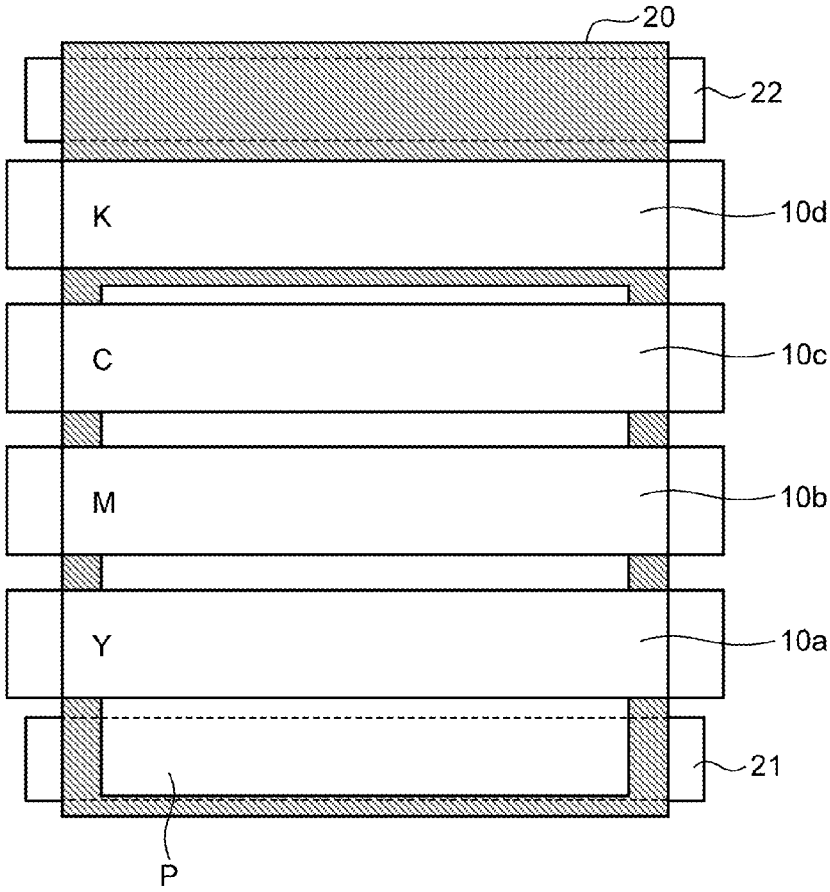
FIG. 2 is a top view of the image forming apparatus according to the embodiment.

FIGS. 1 and 2 are diagrams that schematically illustrate the mechanical configuration of the image forming apparatus according to the embodiment: FIG. 1 is a side view of the image forming apparatus; and FIG. 2 is a top view of the image forming apparatus.

The image forming apparatus according to the embodiment, as illustrated in FIGS. 1 and 2, is configured as a line-type ink jet printer in which four head arrays 10*a* to 10*d* having a sufficient length in the widthwise direction (main-scanning direction) of a recording sheet P are sequentially arranged along a conveying direction (sub-scanning direction) of the recording sheet P. The four head arrays 10*a* to 10*d* correspond to colors yellow (Y), magenta (M), cyan (C) and black (K), respectively, and, by sequentially discharging ink droplets of corresponding colors from the head arrays 10*a* to 10*d* onto the conveyed recording sheet P, a full-color image can be formed on the recording sheet P.

Figure 3:
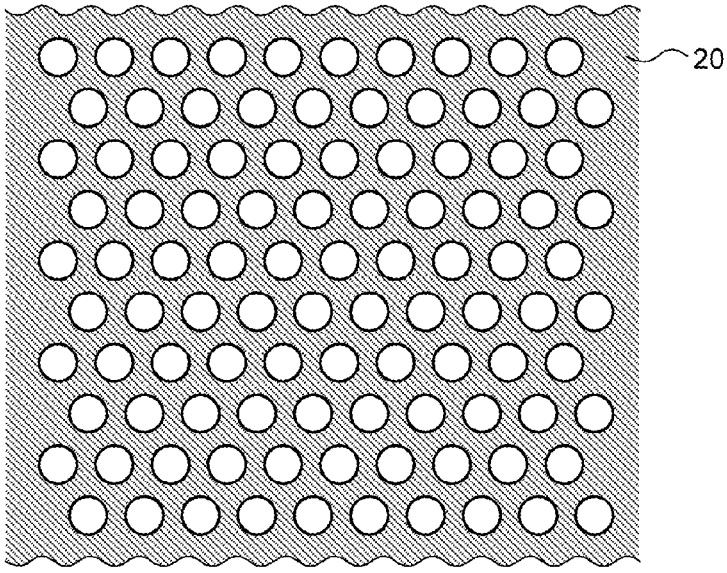
FIG. 3 is an enlarged plan view of a part of a conveying belt.

The recording sheet P is conveyed by a conveying belt 20. The conveying belt 20 is an endless belt that is suspended by using rollers 21 and 22, and, by driving at least one of the rollers 21 and 22 to rotate by using a driving device (not illustrated in the figure), the recording sheet P is conveyed. In the conveying belt 20, as illustrated in FIG. 3, a plurality of through holes is provided. In addition, below a peripheral face of the conveying belt 20 that faces the head arrays 10*a* to 10*d* of the conveying belt 20, a suction fan not illustrated in the figure is provided. The recording sheet P placed on the conveying belt 20 is sucked on an upper side of the conveying belt 20 in accordance with negative pressure generated through the operation of the suction fan and is conveyed.

Figure 4:
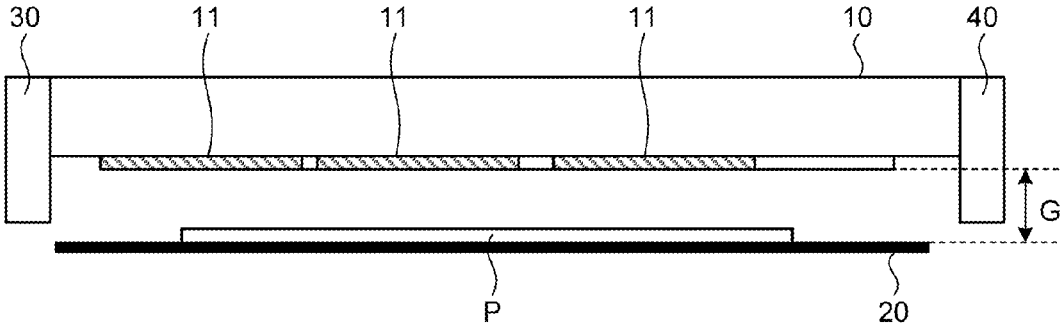
FIG. 4 is a front view of a head array viewed in a direction indicated by arrow A illustrated in FIG. 1.
Figure 5:
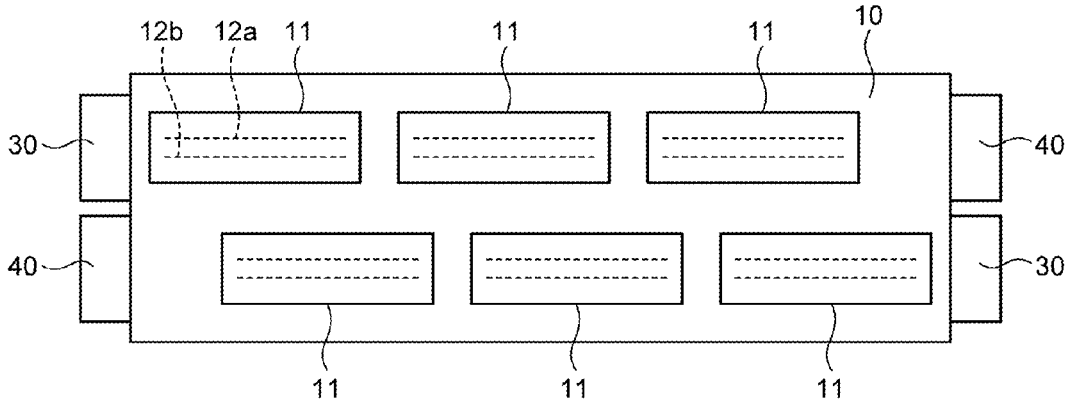
FIG. 5 is a bottom view of the head array viewed in a direction indicated by arrow B illustrated in FIG. 1.

FIGS. 4 and 5 are diagrams in which the head arrays 10*a* to 10*d* (hereinafter, collectively referred to as a head array 10 because the head arrays 10*a* to 10*d* differ only in ink color and have a same configuration) are illustrated in an enlarged manner. FIG. 4 is a front view of the head array 10 viewed in the direction indicated by the arrow A illustrated in FIG. 1, and FIG. 5 is a bottom view of the head array 10 viewed in the direction indicated by the arrow B illustrated in FIG. 1.

In the head array 10, a plurality of print heads 11 are provided on a bottom side facing the conveying belt 20. The plurality of print heads 11, as illustrated in FIG. 5, forms two head rows, in which each row extends along the widthwise direction (the main-scanning direction) of the recording sheet P. The plurality of print heads 11 is arranged in a zigzag pattern so that a gap between end portions of the print heads 11 provided in one head row and a gap between end portions of the print heads 11 provided in another head row do not overlap each other in the conveying direction (the sub-scanning direction) of the recording sheet P.

Each print head 11 is equipped with a plurality of nozzles ejecting ink droplets toward a surface of the recording sheet P. These nozzles are formed in the nozzle face (a face facing the surface of the recording sheet P conveyed by the conveying belt 20) of the print head 11, as two nozzle rows including a nozzle row 12*a* of odd-numbered nozzles corresponding to odd-numbered pixels and a nozzle row 12*b* of even-numbered nozzles corresponding to even-numbered pixels.

During a printing operation in which an image is formed on the recording sheet P, the head array 10 is fixed to a position (hereinafter, referred to as an image forming position) at which the nozzle face of the print heads 11 faces the conveying belt 20 by keeping a distance (gap G) of about 1 mm from the surface of the conveying belt 20, as illustrated in FIG. 4. In a state in which the head array 10 is fixed to the image forming position, ink droplets are discharged from the nozzles of the print heads 11 toward the sheet face of the recording sheet P conveyed by the conveying belt 20, and the ink droplets are attached to the recording sheet P, thereby an image is formed.

In addition, when the print head 11 is left uncapped, ink present inside the nozzles of the print head 11 dries. Accordingly, when the recording sheet P is not present on the conveying belt 20, idle discharge of ink droplets is performed from the nozzles toward the through holes provided in the conveying belt 20 so as to dispose ink, present inside the nozzles, of which the viscosity has increased due to the drying thereof. The ink droplets discharged from the nozzles through the idle discharge is sucked through the through holes provided in the conveying belt 20 by the operation of the suction fan.

Even in a case where the idle discharge of ink droplets described above is performed, when an increase in the viscosity due to the abrupt drying of ink, mixing of air bubbles into the nozzles, attachment of dust or paper powders, or the like occurs, there are cases where some of the nozzles of the print head 11 are clogged to make it difficult to discharge ink droplets. Thus, the image forming apparatus according to the embodiment includes a mechanism (hereinafter, referred to as a defective nozzle detection mechanism) used for optically detecting a defective nozzle remaining in a state incapable of discharging ink droplets.

Figure 6:
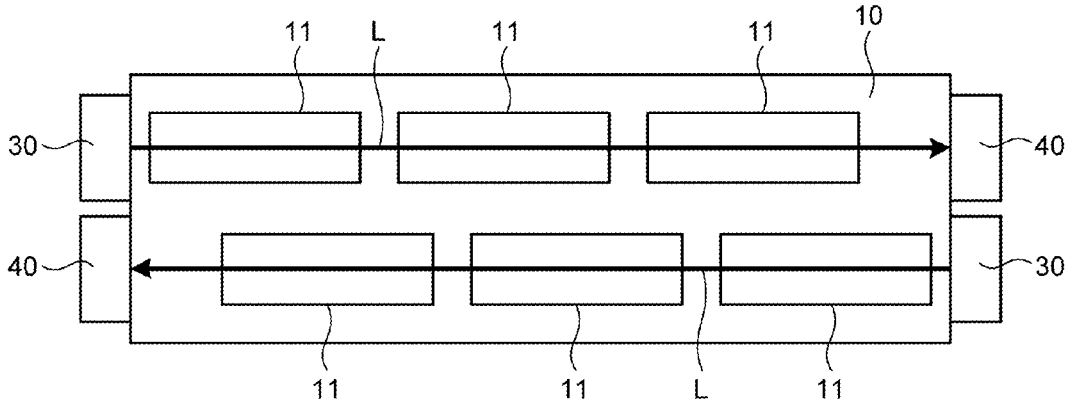
FIG. 6 is a diagram illustrating the arrangement of a light emitting unit and a light receiving unit that are provided in the head array.

The defective nozzle detection mechanism includes a light emitting unit 30 and a light receiving unit 40 that are provided in both end portions of the head array 10 in a longitudinal direction thereof. The light emitting unit 30, as illustrated in FIG. 6, is a unit that generates a detection light L (for example, a laser beam) intersecting the discharge path of ink droplets discharged from the nozzles of the print head 11. The light receiving unit 40 is a unit that receives scattered light generated when the detection light L emitted from the light emitting unit 30 irradiates the ink drops, and the detection light L (hereinafter, referred to as direct light), which passes through the discharge path of ink droplets without impinging against the ink droplets. One pair of the light emitting unit 30 and the light receiving unit 40 is provided for each head row of two head rows provided in the head array 10.

Figure 7:
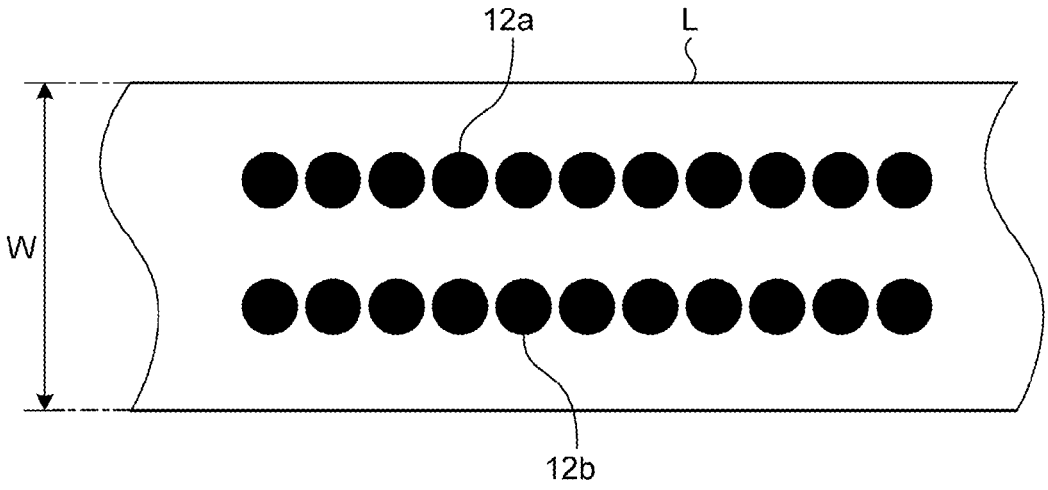
FIG. 7 is a diagram illustrating the relation between a width of a detection light emitted from the light emitting unit and a nozzle array provided in a print head.

The width W of the detection light L generated by the light emitting unit 30, as illustrated in FIG. 7, is sufficiently large compared to the distance between the nozzle row 12*a* of odd-numbered nozzles and the nozzle row 12*b* of even-numbered nozzles that are provided in the print head 11. Accordingly, even in a case where ink droplets are discharged from the nozzle row 12*a* of odd-numbered nozzles, or even in a case where ink droplets are discharged from the nozzle row 12*b* of even-numbered nozzles, the detection light L can irradiate discharged ink droplets without changing the optical path of the detection light L.

Figure 8:
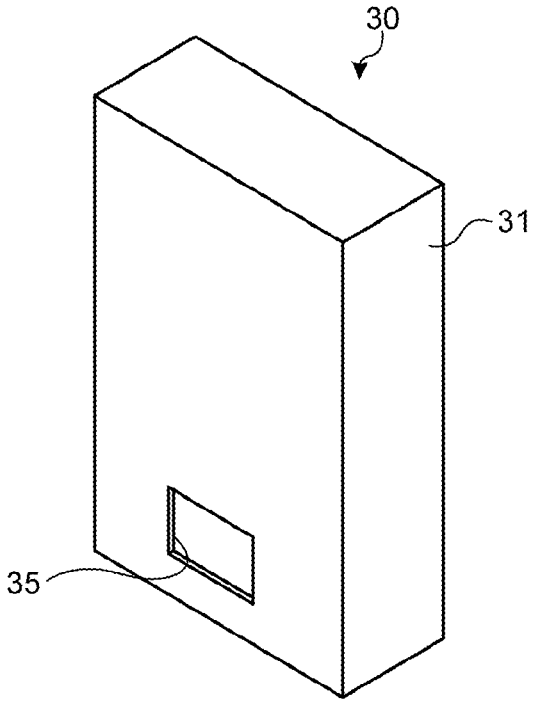
FIG. 8 is a perspective view illustrating an external appearance of the light emitting unit.
Figure 9:
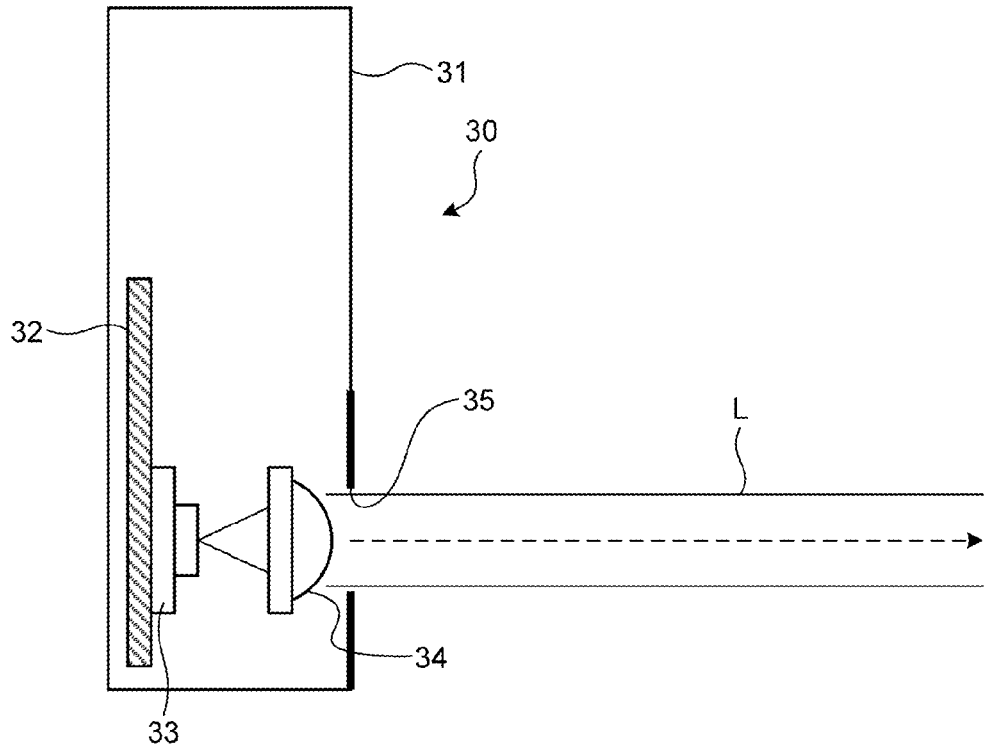
FIG. 9 is a cross-sectional view illustrating an internal configuration of the light emitting unit.

FIGS. 8 and 9 are diagrams illustrating the light emitting unit 30 in detail. FIG. 8 is a perspective view illustrating the external appearance of the light emitting unit 30, and FIG. 9 is a cross-sectional view illustrating the internal configuration of the light emitting unit 30.

The light emitting unit 30 includes a laser diode (LD) driving circuit board 32 that is provided inside a casing 31. An LD 33 that is a light source to emit the detection light L (laser beam) and is mounted on the LD driving circuit board 32. Inside the casing 31, a collimator lens 34 is provided on the optical axis of the detection light L emitted from the LD 33 and collects the detection light L so as to form parallel light. In addition, an aperture 35 used for adjusting the amount of the detection light L passing through the aperture 35 is provided in the casing 31 at a position facing the collimator lens 34.

The detection light L emitted from the LD 33 is collected by the collimator lens 34 and is output to the outside of the casing 31 with the amount of light thereof being adjusted by the aperture 35. The detection light L output to the outside of the casing 31 through the aperture 35 is emitted toward the light receiving unit 40 along the nozzle rows 12*a* and 12*b* provided in the print head 11. Because the LD 33 and the collimator lens 34 as optical components of the light emitting unit 30 are covered with the casing 31, attachment of stains thereto due to mist is prevented.

Figure 10:
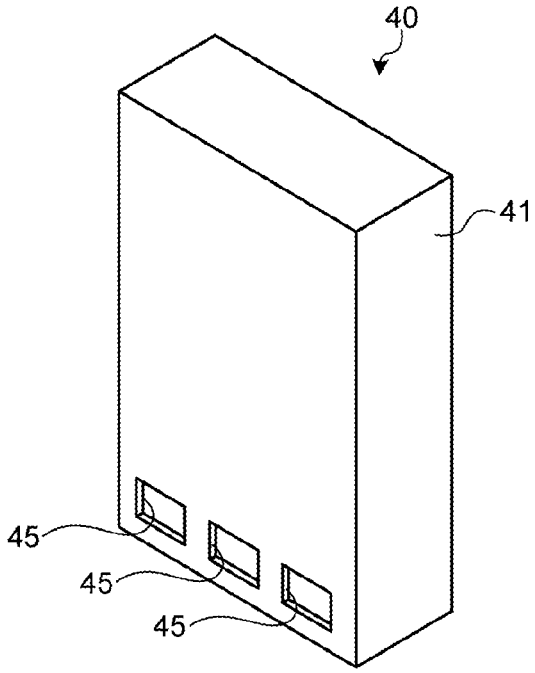
FIG. 10 is a perspective view illustrating an external appearance of the light receiving unit.
Figure 11:
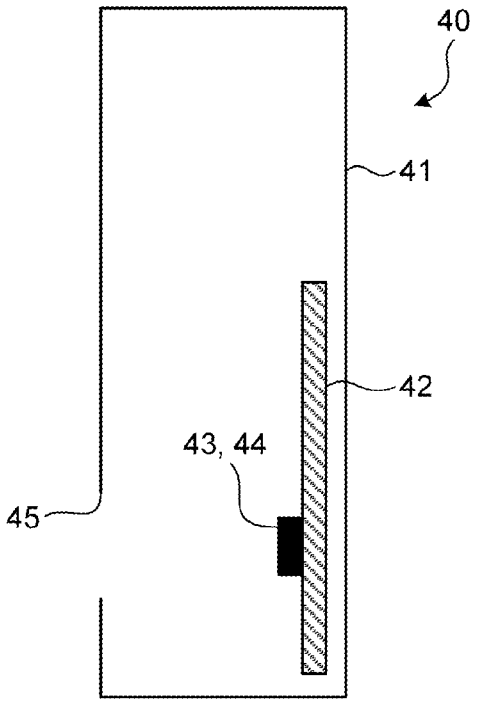
FIG. 11 is a cross-sectional view illustrating an internal configuration of the light receiving unit.
Figure 12:
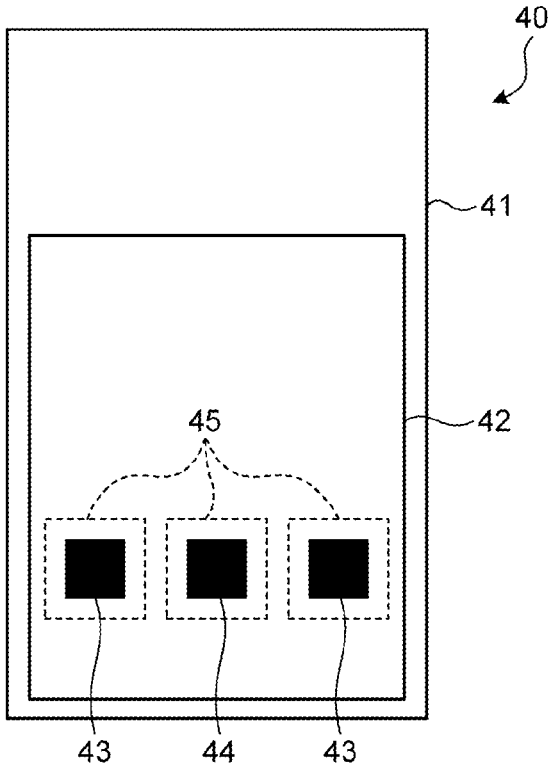
FIG. 12 is a plan view illustrating the internal configuration of the light receiving unit.

FIGS. 10 to 12 are diagrams illustrating the light receiving unit 40 in detail. FIG. 10 is a perspective view illustrating the external appearance of the light receiving unit 40, FIG. 11 is a cross-sectional view illustrating the internal configuration of the light receiving unit 40, and FIG. 12 is a plan view illustrating the internal configuration of the light receiving unit 40.

The light receiving unit 40 includes a photodiode (PD) driving circuit board 42 that is provided inside a casing 41. In the PD driving circuit board 42, a scattered light receiving PD 43 and a direct light receiving PD 44 are provided. The scattered light receiving PD 43 receives scattered light generated by irradiating ink droplets discharged from the nozzle rows 12*a* and 12*b* of the print head 11 with the detection light L generated by the light emitting unit 30 and outputs a first detection signal according to the amount of the received scattered light. The direct light receiving PD 44 receives direct light of the detection light L generated by the light emitting unit 30 and outputs a second detection signal according to the amount of the received direct light. Two scattered light receiving PDs 43 including a PD that receives scattered light originating from the detection light L emitted toward the ink droplets discharged from the nozzle row 12*a* of odd-numbered nozzles and another PD that receives scattered light originating from the detection light L emitted toward the ink droplets discharged from the nozzle row 12*b* of even-numbered nozzles are provided on different sides of the direct light receiving PD 44 interposed therebetween. In addition, light reception holes 45 are formed on the casing 41 at positions facing the scattered light receiving PDs 43 and the direct light receiving PD 44, so that the scattered light and the direct light originating from the detection light L pass through the light reception holes 45 to enter the casing 41.

The scattered light is generated by irradiating the ink droplets discharged from the nozzle rows 12*a* and 12*b* of the print head 11 with the detection light L. The light passes through one of the light reception holes 45 provided to face the corresponding scattered light receiving PD 43, enters the inside of the casing 41 of the light receiving unit 40, and finally reaches the one of the scattered light receiving PD 43. When the scattered light having entered the inside of the casing 41 is received, the one of the scattered light receiving PDs 43 outputs a first detection signal according to the amount of the received scattered light. On the other hand, the direct light of the detection light L, which does not irradiate ink droplets, passes through the light reception hole 45 provided so as to face the direct light receiving PD 44, enters the inside of the casing 41 of the light receiving unit 40, and finally reaches the direct light receiving PD 44. When the direct light having entered the inside of the casing 41 is received, the direct light receiving PD 44 outputs a second detection signal according to the amount of the received direct light. Because the scattered light receiving PD 43 and the direct light receiving PD 44 serving as optical elements of the light receiving unit 40, are covered with the casing 41, attachment of stains thereto due to mist is prevented.

Figure 13:
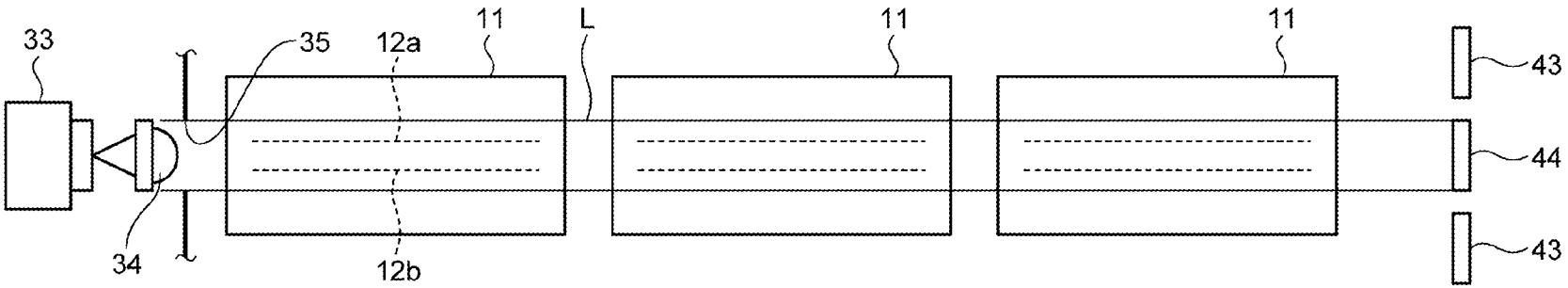
FIG. 13 is a schematic diagram illustrating the appearance of an optical path of the detection light, viewed from the nozzle face side of the print head.

FIG. 13 is a schematic diagram illustrating the optical path of the detection light L, viewed from the nozzle face side of the print head 11. The direct light receiving PD 44 used for receiving the direct light of the detection light L, as illustrated in FIG. 13, is arranged to face the LD 33 so as to be located on the optical axis of the detection light L emitted along the nozzle rows 12*a* and 12*b* of the print head 11. The direct light receiving PD 44 constantly outputs the second detection signal according to the amount of received direct light while the detection light L is emitted from the LD 33.

The head array 10 can be moved between the above-described image forming position and a predetermined standby position which is a different position from the image forming position by a head moving mechanism to be described later. The head array 10 stands by at the standby position in a standby state in which a printing operation is not performed and is moved by the head moving mechanism to the image forming position to be fixed thereto when a printing operation is performed. In addition, when the printing operation ends, the head array 10 is moved back to the standby position by being driven by the head moving mechanism and stands by at the standby position until the next printing operation is to be performed.

Figure 14:
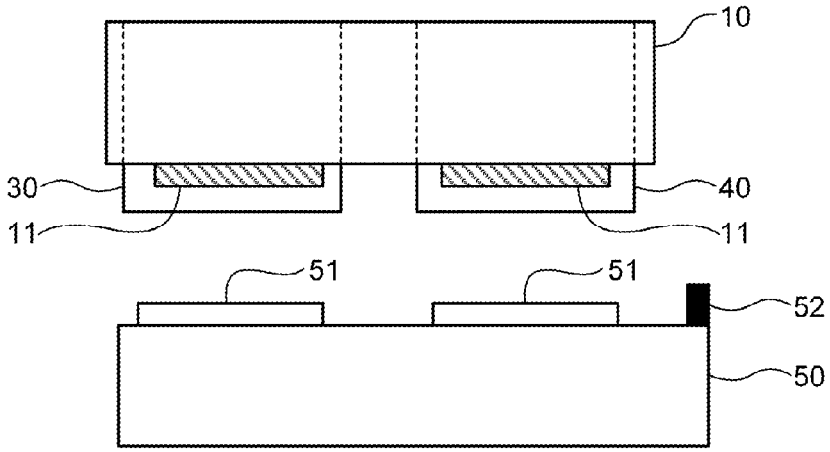
FIG. 14 is a side view illustrating a schematic configuration of a capping unit that caps a print head.

A capping unit 50 that caps the print head 11 of the head array 10 is provided at the standby position. In the capping unit 50, as illustrated in FIG. 14, a cap 51 corresponding to the print head 11 of the head array 10 and a wiper 52 that cleans nozzles by wiping the nozzle face of the print head 11 are provided. The wiper 52 is formed by an elastic member such as rubber so as not to damage the nozzle face of the print head 11.

The head array 10 can be moved in the vertical direction or the horizontal direction from the standby position by the driving of the head moving mechanism. When the nozzles are to be cleaned, the head array 10 moves to a position at which the nozzle face of the print head 11 is brought into contact with the wiper 52 of the capping unit 50 and horizontally moves in a state in which the wiper 52 is in contact with the nozzle face, thereby wiping the nozzle face. In addition, in the capping unit 50, a suction pump not illustrated in the figure is provided. When the nozzles are to be cleaned, ink which has an increased viscosity, or air bubbles inside the nozzles are sucked by the suction pump. The ink sucked from the inside of the nozzles is sent to a suction tank not illustrated in the figure.

In the image forming apparatus according to the embodiment, a process for detecting a defective nozzle by using the above-described defective nozzle detection mechanism is performed during a printing operation, and, in a case where a defective nozzle is detected during the printing operation, the head array 10 is driven by the head moving mechanism to move from the image forming position to the standby position and cleans the defective nozzle through the above-described cleaning operation. In addition, in the image forming apparatus according to the embodiment, even in a state in which the head array 10 is located at the standby position, the process for detecting a defective nozzle can be performed by the above-described defective nozzle detection mechanism. In a case where the process for detecting a defective nozzle is performed at the standby position, ink droplets are discharged from the nozzles of the print head 11 to the inside of the cap 51 of the capping unit 50, and the ink discharged to the inside of the cap 51 is sucked by the suction pump.

Figure 15:
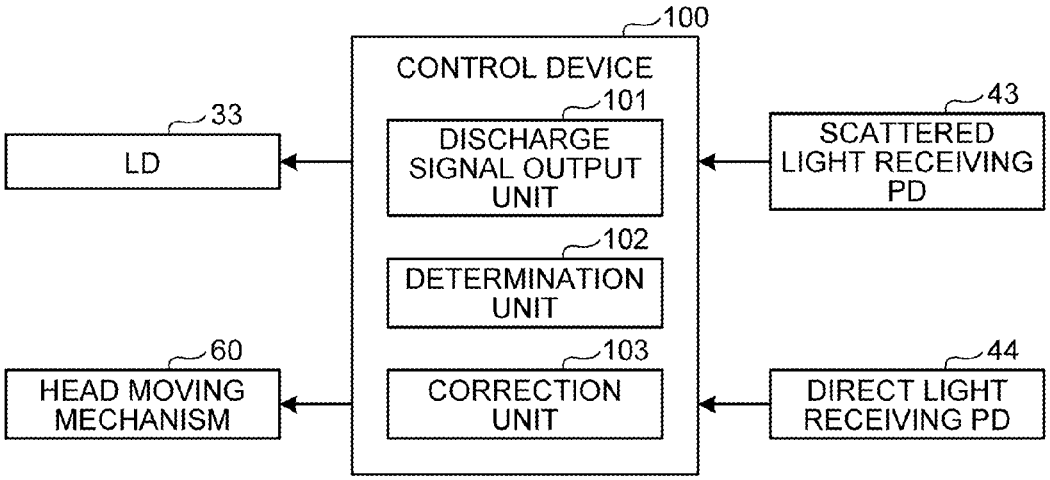
FIG. 15 is a block diagram illustrating the configuration of a control system relating to a defective nozzle detection mechanism of the image forming apparatus according to the embodiment.

FIG. 15 is a block diagram illustrating the configuration of a control system relating to the defective nozzle detection mechanism of the image forming apparatus according to the embodiment.

As illustrated in FIG. 15, the LD 33 of the light emitting unit 30, the scattered light receiving PD 43 and the direct light receiving PD 44 of the light receiving unit 40, and a head moving mechanism 60 are connected to a control device 100. The control device 100 is configured, for example, as a microcomputer that includes a central processing unit (CPU), a read only memory (ROM), a random access memory (RAM), an input/output interface circuit, and the like. In this control device 100, for example, a defective nozzle detecting program stored in the ROM is executed by the CPU using the RAM as a work area, and accordingly, the control functions of a discharge signal output unit 101, a determination unit 102, and a correction unit 103 are realized, whereby the process for detecting a defective nozzle is performed.

The discharge signal output unit 101 outputs a discharge signal that is used to discharge an ink droplet from a nozzle as a target for detecting a defect (hereinafter, referred to as a detection target nozzle).

When a discharge signal is output from the discharge signal output unit 101, the determination unit 102 determines whether or not the detection target nozzle is a defective nozzle unable to discharge an ink droplet based on the first detection signal that is output from the scattered light receiving PD 43 of the light receiving unit 40.

The correction unit 103 corrects the determination result of the determination unit 102 based on the second detection signal that is output from the direct light receiving PD 44 of the light receiving unit 40.

The image forming apparatus according to the embodiment performs the process of detecting a defective nozzle immediately before printing and during a printing operation in a state in which the head array 10 is fixed to the image forming position under the control of the control device 100. When the process of detecting a defective nozzle is started, the control device 100, first, outputs the detection light L by driving the LD 33 of the light emitting unit 30. The detection light L is emitted to the inside of the gap G between the nozzle face of the print head 11 and the conveying belt 20 so as to intersect the ink droplets discharged from the nozzles provided in the print head 11 of the head array 10.

In the state in which the detection light L emitted from the light emitting unit 30 is emitted to the inside of the gap G, the discharge signal output unit 101 of the control device 100 outputs a discharge signal which is used for discharging an ink droplet from a detection target nozzle. When the detection target nozzle is normal, an ink droplet is discharged from the detection target nozzle in accordance with the discharge signal. When the ink droplet is discharged from the detection target nozzle, the detection light L output from the light emitting unit 30 irradiates the ink droplet, and accordingly, scattered light is generated, and the scattered light of the detection light L is received by the scattered light receiving PD 43 of the light receiving unit 40. In a case where the scattered light receiving PD 43 receives the scattered light of the detection light L, the first detection signal output from the scattered light receiving PD 43 indicates a high value.

On the other hand, in a case where the detection target nozzle is a defective nozzle that cannot discharge any ink droplet, even when a discharge signal is output from the discharge signal output unit 101, no ink droplet is discharged, and the scattered light of the detection light L is not generated. Accordingly, the first detection signal that is output from the scattered light receiving PD 43 of the light receiving unit 40 remains as a low value.

The determination unit 102 monitors the output of the scattered light receiving PD 43 when a discharge signal transmitted from the discharge signal output unit 101 is output. In a case where the first detection signal output from the scattered light receiving PD 43 in accordance with the output of the discharge signal exceeds a predetermined first threshold value, the determination unit 102 determines that the detection target nozzle is a normal nozzle. On the other hand, in a case where the first detection signal output from the scattered light receiving PD 43 in accordance with the output of the discharge signal is below or equal to the first threshold value, the determination unit 102 determines that the detection target nozzle is a defective nozzle.

As above, the determination unit 102 determines whether the detection target nozzle is a normal nozzle that can normally discharge an ink droplet or a defective nozzle that cannot discharge an ink droplet based on whether or not the first detection signal output from the scattered light receiving PD 43 exceeds the first threshold value in response to the discharge signal output from the discharge signal output unit 101. However, in a case where the detection light L is blocked by the conveying belt 20 or a recording sheet P due to the unexpected occurrence of the floating of the conveying belt 20 that conveys the recording sheet P or the floating of the recording sheet P conveyed by the conveying belt 20, even when the ink droplet is normally discharged from the detection target nozzle, the first detection signal output from the scattered light receiving PD 43 becomes below or equal to the first threshold value, and accordingly, there is a case where the determination unit 102 incorrectly determines the detection target nozzle as a defective nozzle.

Thus, in the image forming apparatus according to the embodiment, the direct light receiving PD 44 for receiving direct light from the detection light L is provided in the light receiving unit 40, the correction unit 103 is provided in the control device 100, and the correction unit 103 corrects the determination result of the determination unit 102 based on the second detection signal output from the direct light receiving PD 44.

The direct light receiving PD 44 of the light receiving unit 40 constantly outputs the second detection signal according to the amount of the received direct light while the LD 33 of the light emitting unit 30 emits the detection light L, as described above. Although the detection light L is attenuated in a case where scattered light is generated by irradiating the ink droplet discharged from the detection target nozzle with the detection light L, the detection light L is markedly attenuated in a case where the detection light L is blocked due to unexpected floating of the conveying belt 20 or the recording sheet P.

The correction unit 103 of the control device 100 constantly monitors the second detection signal that is output from the direct light receiving PD 44, and, in a case where the determination unit 102 determines that the detection target nozzle is a defective nozzle, the correction unit 103 compares the second detection signal output from the direct light receiving PD 44 with a predetermined second threshold value at the same operational timing as that of the first detection signal used for the determination. In a case where the second detection signal output from the direct light receiving PD 44 exceeds the second threshold value, the correction unit 103 validates the determination result of the determination unit 102. On the other hand, in a case where the second detection signal output from the direct light receiving PD 44 is below or equal to the second threshold value, the correction unit 103 invalidates the determination result of the determination unit 102. That is, even in a case where the determination unit 102 determines that the detection target nozzle is a defective nozzle because the first detection signal output from the scattered light receiving PD 43 is below or equal to the first threshold value, when the second detection signal output from the direct light receiving PD 44 is below or equal to the second threshold value, there is a high possibility that the cause of the first detection signal output from the scattered light receiving PD 43 being below or equal to the first threshold value is not the non-discharge of an ink droplet from the detection target nozzle but the blocking of the detection light L due to unexpected floating of the conveying belt 20 or the recording sheet P, and accordingly, the correction unit 103 invalidates the determination result of the determination unit 102.

In a case where the correction unit 103 invalidates the determination result of the determination unit 102, the determination is made again regarding whether or not the detection target nozzle of which the determination result has been invalidated is a defective nozzle. Thereafter, the discharge signal output unit 101 re-outputs a discharge signal that is used for discharging an ink droplet from the detection target nozzle of which the determination result of the determination unit 102 has been invalidated. Then, the determination unit 102 monitors the first detection signal output from the scattered light receiving PD 43 in response to the discharge signal re-output from the discharge signal output unit 101 and makes a determination again as to whether the detection target nozzle is a normal nozzle or a defective nozzle based on whether or not the first detection signal exceeds the first threshold value.

The control device 100 repeatedly performs the above-described process to detect a defective nozzle for the nozzles provided in the print head 11 of the head array 10 before printing and during a printing operation while sequentially changing the detection target nozzle. In a case where the process for detecting a defective nozzle is performed immediately before printing, in the state in which the head array 10 is driven by the head moving mechanism 60 to be fixed to the image forming position, ink droplets are sequentially discharged starting from the nozzle located at the end portion of the print head 11 at operational timing at which the through hole provided in the conveying belt 20 is right below the detection target nozzle while the conveying belt 20 is rotated, and the discharge state of an ink droplet from each nozzle is checked. In addition, in a case where the process for detecting a defective nozzle is performed during a printing operation, in the state in which the head array 10 is driven by the head moving mechanism 60 to be fixed to the image forming position, when a space in which a recording sheet P is not present between two recording sheets P sequentially conveyed by the conveying belt 20 arrives at a position facing the head array 10, ink droplets are sequentially discharged starting from the nozzle located at the end portion of the print head 11 at operational timing at which the through hole provided in the conveying belt 20 is right below the detection target nozzle, and the discharge state of an ink droplet from each nozzle is checked.

In a case where the process for detecting a defective nozzle is performed at the image forming position before printing or during a printing operation, if the determination unit 102 determines that the detection target nozzle is a defective nozzle, and the correction unit 103 validates the determination result of the determination unit 102, as described above, the head array 10 is driven by the head moving mechanism 60 to move from the image forming position to the standby position, and a cleaning operation for the defective nozzle is performed at the standby position.

Figure 16:
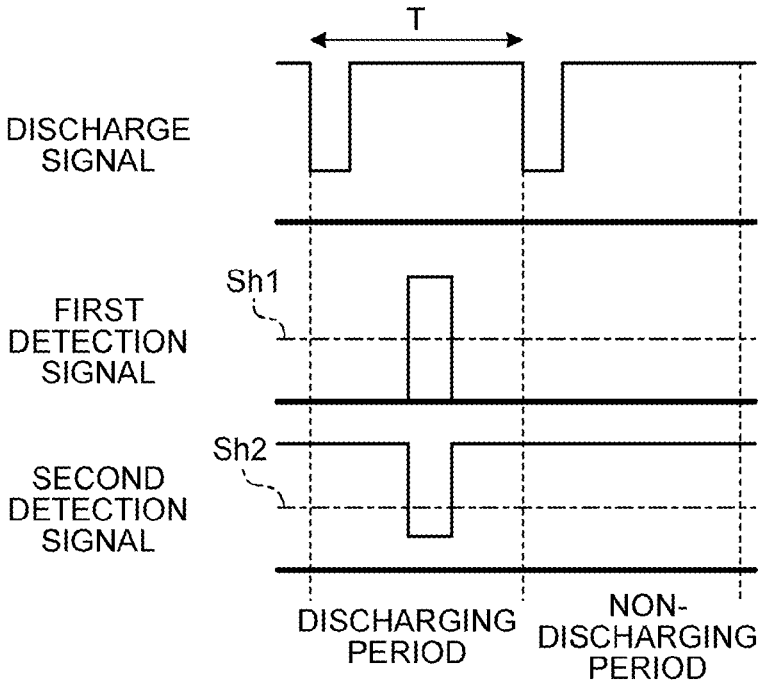
FIG. 16 is a timing chart of a case where a process for detecting a defective nozzle is performed in a normal state in which detection light is not blocked by a conveying belt or a recording sheet.

FIG. 16 is a timing chart of a case where the process for detecting a defective nozzle is performed in a normal state in which the detection light L is not blocked by the conveying belt 20 or a recording sheet P and is a diagram illustrating the relation between the discharge signal output from the discharge signal output unit 101, the first detection signal output from the scattered light receiving PD 43, and the second detection signal output from the direct light receiving PD 44 by comparing a case where an ink droplet is discharged from the detection target nozzle and a case where any ink droplet is not discharged from the detection target nozzle.

When the process for detecting a defective nozzle is started, in the state in which the detection light L is emitted, a discharge signal is output from the discharge signal output unit 101 at a period T, and the nozzles of the print head 11 are operated so as to sequentially discharge ink droplets at a time interval T. Here, in a case where the detection target nozzle discharges an ink droplet, scattered light is generated by irradiating the discharged ink droplet with the detection light L, and accordingly, the first detection signal output from the scattered light receiving PD 43 has a high value exceeding the first threshold value Sh1. In addition, when the ink droplet is discharged, the detection light L is blocked by the ink droplet, and accordingly, the second detection signal output from the direct light receiving PD 44 is attenuated.

On the other hand, in a case where an ink droplet is not discharged from the detection target nozzle, the detection light L does not irradiate the ink droplet, so that the scattered light is not generated. Accordingly, the first detection signal output from the scattered light receiving PD 43 remains at a low value, which is below or equal to the first threshold value Sh1. In addition, in a case where an ink droplet is not discharged, the detection light L is not blocked by the ink droplet, and accordingly, the second detection signal output from the direct light receiving PD 44 maintains a high value that exceeds the second threshold value Sh2.

In a case where the first detection signal output from the scattered light receiving PD 43 in response to the discharge signal exceeds the first threshold value Sh1, the determination unit 102 determines that an ink droplet is discharged from the detection target nozzle and determines that the detection target nozzle is a normal nozzle. On the other hand, in a case where the first detection signal output from the scattered light receiving PD 43 in response to the discharge signal is below or equal to the first threshold value Sh1, the determination unit 102 determines that an ink droplet is not discharged from the detection target nozzle and determines that the detection target nozzle is a defective nozzle.

In a case where the first detection signal output from the scattered light receiving PD 43 is below or equal to the first threshold value Sh1, the second detection signal output from the direct light receiving PD 44 is used in a correction process by the correction unit 103. In a case where the first detection signal output from the scattered light receiving PD 43 is below or equal to the first threshold value Sh1, and the detection target nozzle is determined as a defective nozzle by the determination unit 102, the correction unit 103 compares the second detection signal output from the direct light receiving PD 44 in response to the discharge signal with the second threshold value Sh2 and invalidates the determination result of the determination unit 102 in a case where the second detection signal is below or equal to the second threshold value Sh2. In a case where the first detection signal output from the scattered light receiving PD 43 exceeds the first threshold value Sh1, and the detection target nozzle is determined as a normal nozzle by the determination unit 102, it is understood that the detection light L is not blocked by the conveying belt 20, a recording sheet P, or the like based on the results, and accordingly, the correction using the second detection signal output from the direct light receiving PD 44 is not performed.

Figure 17:
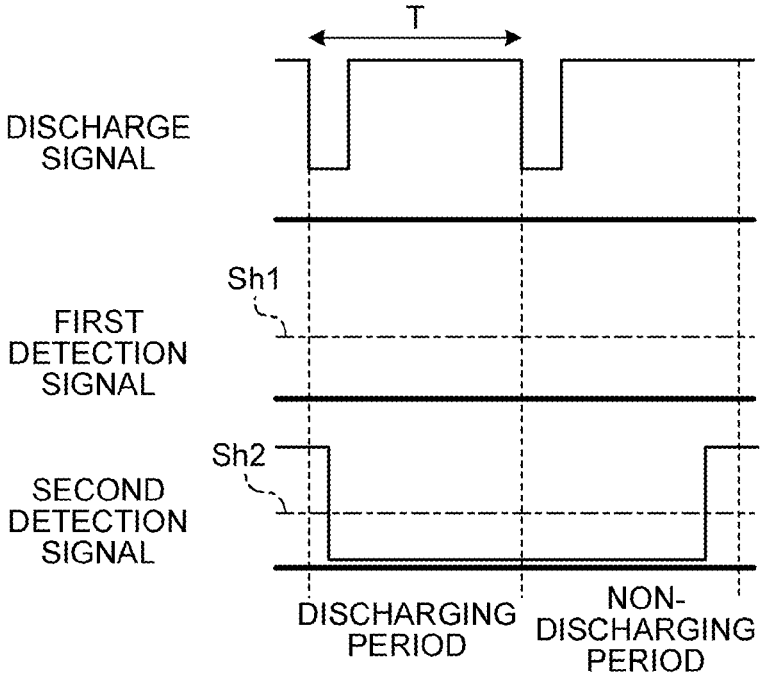
FIG. 17 is a timing chart of a case where a process for detecting a defective nozzle is performed in a state in which the detection light is blocked by the conveying belt or the recording sheet.

FIG. 17 is a timing chart of a case where the process for detecting a defective nozzle is performed in a state in which the detection light L is blocked by the conveying belt 20 or the recording sheet P and illustrates the relation between the discharge signal output from the discharge signal output unit 101, the first detection signal output from the scattered light receiving PD 43, and the second detection signal output from the direct light receiving PD 44 by comparing a case where an ink droplet is discharged from the detection target nozzle and a case where no ink droplet is discharged from the detection target nozzle.

In a case where the detection light L is blocked by the conveying belt 20 or a recording sheet P, even when the detection target nozzle discharges an ink droplet, the detection light L does not irradiate the discharged ink droplet, so that scattered light is not generated, and accordingly, the first detection signal output from the scattered light receiving PD 43 remains as a low value, which is below or equal to the first threshold value Sh1 In addition, even in a case where the detection target nozzle does not discharge an ink droplet, the first detection signal output from the scattered light receiving PD 43 is below or equal to the first threshold value Sh1. Accordingly, the determination unit 102 determines that the detection target nozzle is a defective nozzle regardless of whether or not an ink droplet is discharged from the detection target nozzle.

In a case where the detection light L is blocked by the conveying belt 20 or the recording sheet P, the second detection signal output from the direct light receiving PD 44 is, in comparison to the second detection signal at a normal state (see FIG. 16), markedly attenuated to be below or equal to the second threshold value Sh2. In a case where the determination unit 102 determines that the detection target nozzle is a defective nozzle, the correction unit 103 compares the second detection signal output from the direct light receiving PD 44 with the second threshold value Sh2. In a case where the second detection signal is below or equal to the second threshold value Sh2, the correction unit 103 determines that there is a high possibility that the detection light L is blocked by an unexpected floating of the conveying belt 20 or the recording sheet P and thus invalidates the determination result of the determination unit 102.

Figure 18:
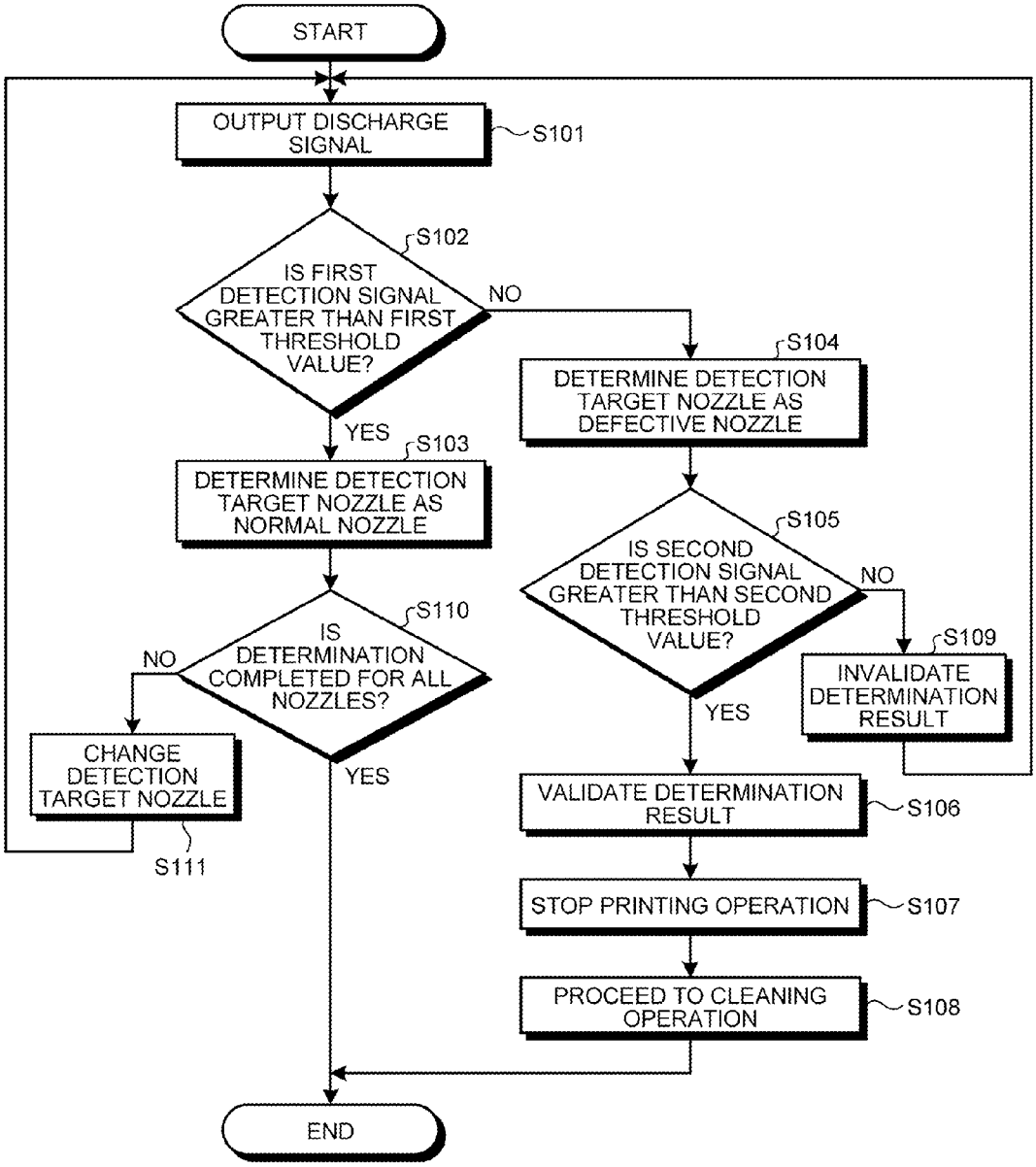
FIG. 18 is a flowchart illustrating the flow of a process for detecting a defective nozzle performed in a state in which a head array is fixed to an image forming position immediately before printing and during a printing operation.

FIG. 18 is a flowchart illustrating the flow of the process for detecting a defective nozzle that is performed in a state in which the head array 10 is fixed to the image forming position immediately before printing or during a printing operation.

If the process is started in a state in which the detection light L is emitted from the light emitting unit 30, the discharge signal output unit 101 of the control device 100 outputs a discharge signal used for discharging an ink droplet from the detection target nozzle (Step S101). Then, the determination unit 102 of the control device 100 reads in the first detection signal output from the scattered light receiving PD 43 in response to the discharge signal and compares the first detection signal with the first threshold value Sh1 (Step S102). Here, in a case where the first detection signal exceeds the first threshold value Sh1 (Yes at Step S102), the determination unit 102 determines that the detection target nozzle is a normal nozzle (Step S103). On the other hand, in a case where the first detection signal is below or equal to the first threshold value Sh1 (No at Step S102), the determination unit 102 determines the detection target nozzle as a defective nozzle (Step S104).

In a case where the determination unit 102 determines that the detection target nozzle is the defective nozzle, the correction unit 103 of the control device 100 compares the second detection signal output from the direct light receiving PD 44 at the same operational timing as the timing of the first detection signal used in the determination process of the determination unit 102 with the second threshold value Sh2 (Step S105). Then, in a case where the second detection signal exceeds the second threshold value Sh2 (Yes at Step S105), the correction unit 103 validates the determination result of the determination unit 102, determining that the detection target nozzle is defective (Step S106). In this case, the printing operation of the image forming apparatus is stopped (Step S107), and the process proceeds to a cleaning operation (Step S108). In this case, the head array 10 is driven by the head moving mechanism 60 to move from the image forming position to the standby position. Then, in the state in which the head array 10 is located at the standby position, the cleaning operation for the defective nozzle is performed.

On the other hand, in a case where the second detection signal is below or equal to the second threshold value Sh2 (No at Step S105), the correction unit 103 invalidates the determination result of the determination unit 102 determining that the detection target nozzle is the defective nozzle (Step S109). In this case, the process is returned to Step S101, and the above process of Step S101 and processes afterward are performed again for the detection target nozzle of which the determination result of the determination unit 102 has been invalidated.

The above-described process is repeatedly performed for each nozzle provided in the print head 11 of the head array 10. That is, at Step S110, it is determined whether the process for detecting a defective nozzle has been completed for all the nozzles provided in the print head 11. In a case where the process for all the nozzles has not been completed (No at Step S110), the detection target nozzle is changed (Step S111), the process is returned to S101, and the above process of Step S101 and the subsequent processes are repeated for a new detection target nozzle. When the process for all the nozzles is completed (Yes at Step S110), the series of processes illustrated in the flowchart illustrated in FIG. 18 ends.

As described above, in the image forming apparatus according to the embodiment the process for detecting a defective nozzle can be performed in a state in which the head array 10 is located at the standby position. In a case where the process for detecting a defective nozzle is performed in the state in which the head array 10 is located at the standby position, the detection light L emitted from the light emitting unit 30 is not blocked by the conveying belt 20 or the recording sheet P, and accordingly, the process uses only the first detection signal output from the scattered light receiving PD 43 is performed.

Figure 19:
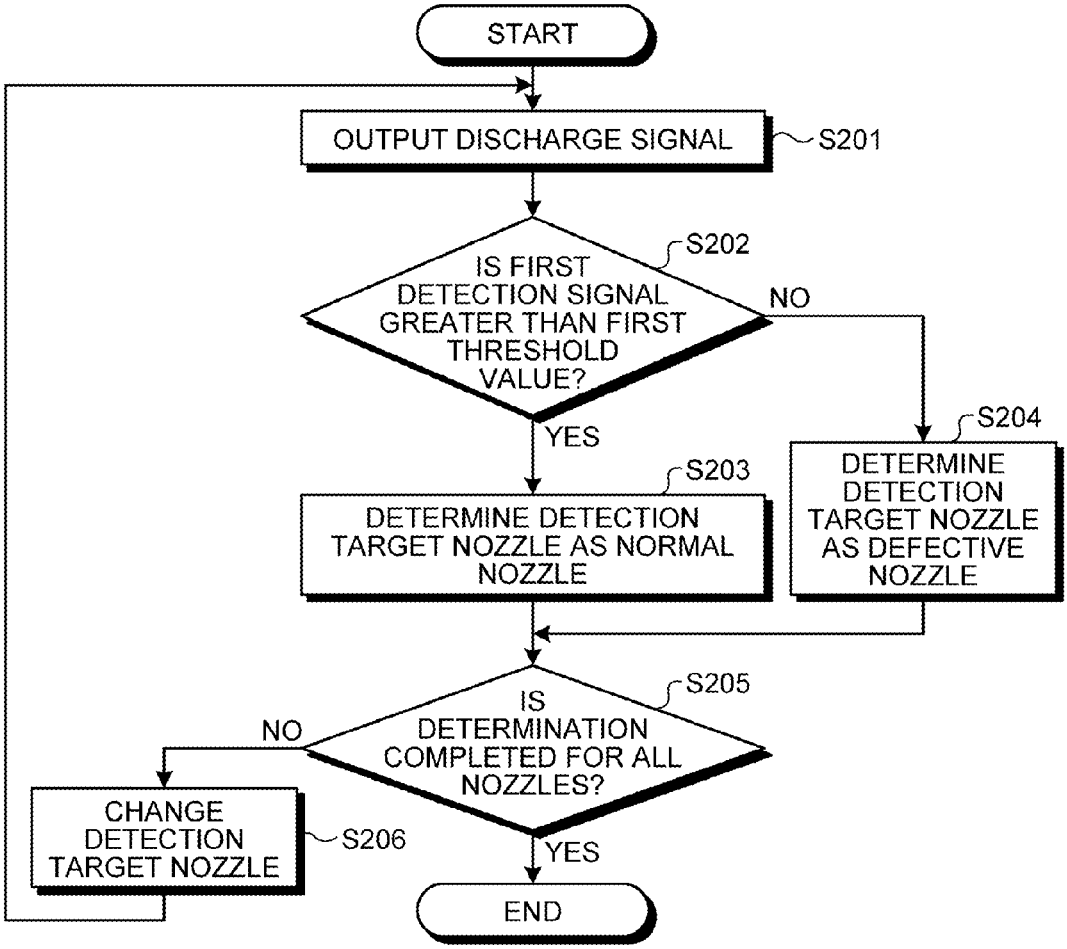
FIG. 19 is a flowchart illustrating the flow of a process for detecting a defective nozzle performed in a state in which the head array is placed at a standby position.

FIG. 19 is a flowchart illustrating the flow of the process for detecting a defective nozzle that is performed in the state in which the head array 10 is located at the standby position.

When the process is started, first, in a state in which the detection light L is emitted from the light emitting unit 30, the discharge signal output unit 101 of the control device 100 outputs a discharge signal used for discharging an ink droplet from the detection target nozzle (Step S201). Then, the determination unit 102 of the control device 100 reads in the first detection signal output from the scattered light receiving PD 43 in response to the discharge signal and compares the first detection signal with the first threshold value Sh1 (Step S202). Here, in a case where the first detection signal exceeds the first threshold value Sh1 (Yes at Step S202), the determination unit 102 determines that the detection target nozzle is normal (Step S203). On the contrary, in a case where the first detection signal is below or equal to the first threshold value Sh1 (No at Step S202), the determination unit 102 determines that the detection target nozzle is a defective nozzle (Step S204).

The above-described process is repeatedly performed for each nozzle provided in the print head 11 of the head array 10. That is, at Step S205, it is determined whether the process for detecting a defective nozzle has been completed for all the nozzles provided in the print head 11. In a case where the process for all the nozzles has not been completed (No at Step S205), the detection target nozzle is changed (Step S206), the process is returned to Step S201, and the process of Step S201 and the subsequent processes are repeated for a new detection target nozzle. When the process for all the nozzles is completed (Yes at Step S205), the series of processes illustrated in the flowchart illustrated in FIG. 19 ends.

For example, in the image forming apparatus according to the embodiment when the head array 10 is located at the standby position at the time of startup, the process for detecting a defective nozzle is performed. Then, in a case where it is determined that there are no defective nozzles, the head array 10 is moved to the image forming position, and the process for detecting a defective nozzle is performed again immediately before a printing operation in the state in which the head array 10 is fixed to the image forming apparatus. In addition, even during the printing operation, the process for detecting a defective nozzle is performed as necessary. Accordingly, in a case where there is a defective nozzle, the defective nozzle is promptly detected, and a countermeasure such as a cleaning process can be performed quickly.

Figure 20:
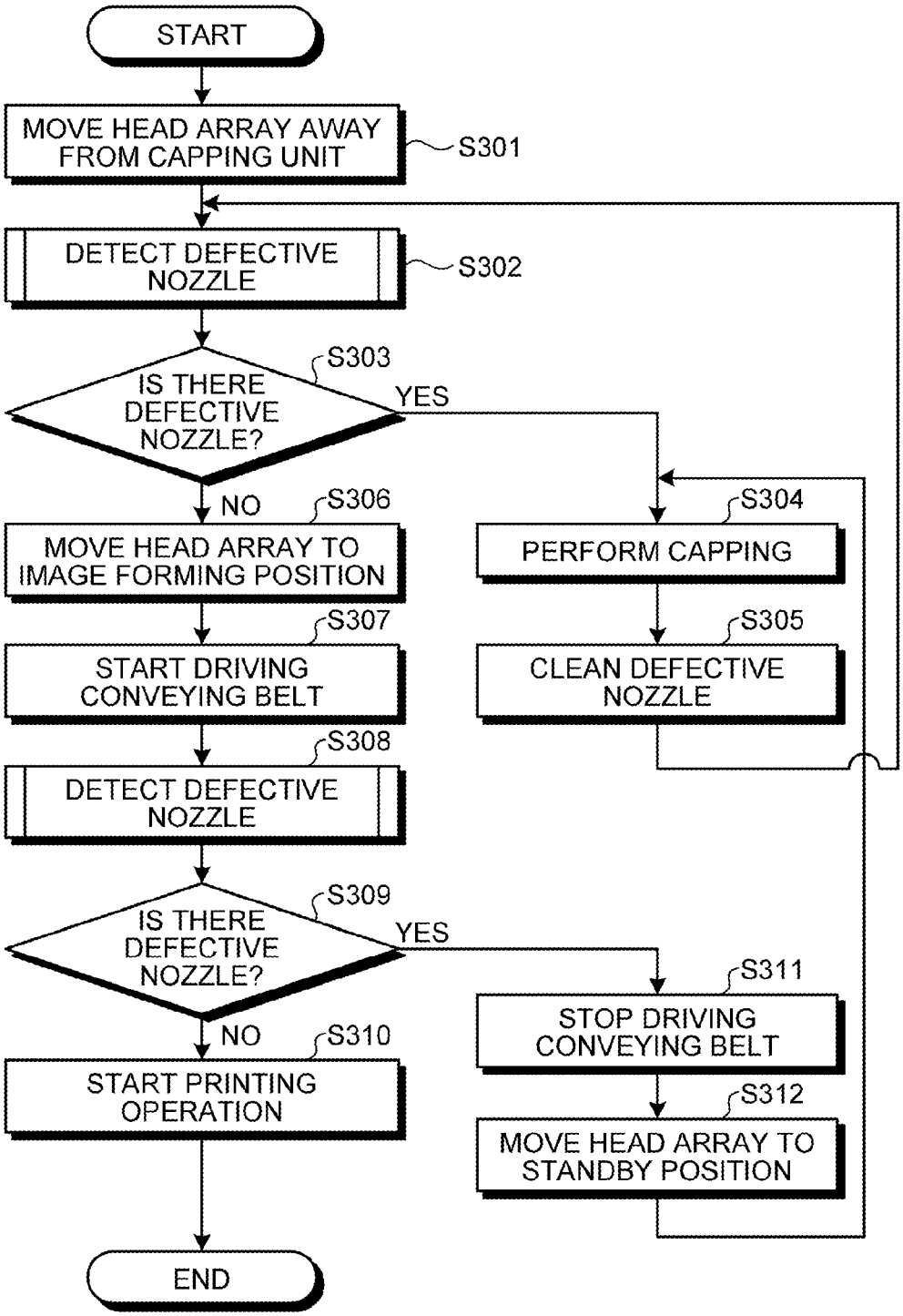
FIG. 20 is a flowchart illustrating the flow of a process for detecting a defective nozzle that is performed when an image forming apparatus is started up.

FIG. 20 is a flowchart illustrating the flow of a series of processes that are performed from the startup of the image forming apparatus to the start of a printing operation.

When the image forming apparatus starts up, and the process is started, the head array 10 moves from the standby position to a direction away from the capping unit 50 (Step S301). Then, in the state in which the head array 10 is away from the capping unit 50, the process for detecting a defective nozzle shown in the flowchart illustrated in FIG. 19 is performed. At this time, each of the nozzles provided in the print head 11 of the head array 10 sequentially discharges ink droplets toward the cap 51 of the capping unit 50 in response to a discharge signal output from the discharge signal output unit 101.

Next, it is determined, through the process of Step S302, whether or not a defective nozzle has been detected (Step S303), and, in a case where the defective nozzle has been detected (Yes at Step S303), the print head 11 is capped (Step S304), and a cleaning process for the defective nozzle is performed (Step S305). Then, the process is returned to Step S302, and the process for detecting a defective nozzle illustrated in the flowchart illustrated in FIG. 19 is performed again.

On the other hand, in a case where a defective nozzle has not been detected through the process of Step S302 (No at Step S303), the head array 10 is driven by the head moving mechanism 60 to move from the standby position to the image forming position (Step S306). Then, the driving of the conveying belt 20 is started (Step S307), and, before a recording sheet P is conveyed, the process for detecting a defective nozzle, illustrated in the flowchart illustrated in FIG. 18, is performed (Step S308). At this time, each nozzle provided in the print head 11 of the head array 10 sequentially discharges ink droplets toward the through hole provided in the conveying belt 20 in response to a discharge signal output from the discharge signal output unit 101.

Next, it is determined, through the process of Step S308, whether or not a defective nozzle has been detected (Step S309), and, in a case where a defective nozzle is not detected (No at Step S309), a printing operation is started (Step S310). On the other hand, in a case where a defective nozzle has been detected (Yes at Step S309), the driving of the conveying belt 20 is stopped (Step S311), and the head array 10 is driven by the head moving mechanism 60 to move from the image forming position to the standby position (Step S312). Then, the print head 11 is capped (Step S304), a cleaning operation is performed for the defective nozzle (Step S305), the process is returned to Step S302, and the process for detecting a defective nozzle illustrated in the flowchart illustrated in FIG. 19 is performed again.

As described in detail with reference to a specific example above, in the image forming apparatus according to the embodiment, in a case where first detection signal output from the scattered light receiving PD 43 in response to the output of a discharge signal used for discharging an ink droplet from a detection target nozzle is below or equal to the first threshold value, the determination unit 102 determines that the detection target nozzle is a defective nozzle. In a case where the detection target nozzle has been determined to be a defective nozzle by the determination unit 102, the correction unit 103 compares the second detection signal output from the direct light receiving PD 44 with the second threshold value and invalidates the determination result of the determination unit 102 in a case where the second detection signal is below or equal to the second threshold value. Accordingly, even in a case where the process for detecting a defective nozzle is performed during a printing operation, an incorrect determination of the determination unit 102, which is generated because the detection light L is blocked by the conveying belt 20 or the recording sheet P, is effectively prevented, and therefore, a defective nozzle can be detected with high accuracy.

In addition, the image forming apparatus according to the embodiment repeatedly performs the process for detecting a defective nozzle for the detection target nozzle of which the determination result of the determination unit 102 has been invalidated, and accordingly, a defective nozzle can be reliably detected.

Furthermore, in the image forming apparatus according to the embodiment, in a case where a defective nozzle is detected as a result of performing the process of detecting a defective nozzle in the state in which the head array 10 is fixed to the image forming position immediately before printing or during a printing operation, the printing operation is stopped, and the head array 10 is moved to the standby position so as to perform a cleaning operation for the defective nozzle, whereby the deterioration of the quality of an image formed on the recording sheet P can be prevented in advance.

According to the present invention, an advantage is acquired to be capable of detecting a defective nozzle that cannot discharge an ink droplet with high accuracy even in a printing operation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a recording sheet conveyed by a conveying unit by discharging ink droplets from nozzles provided in a print head on the recording sheet, the image forming apparatus comprising:

a light emitting unit that generates detection light intersecting a discharge path of the ink droplets;

a discharge signal output unit that outputs a discharge signal used to make the ink droplets discharge from a detection target nozzle that is a target for detecting a defective nozzle from among the nozzles;

a first light receiving unit that receives scattered light generated by the ink droplets being irradiated with the detection light and outputs a first detection signal in proportion to an amount of the received light;

a second light receiving unit that receives the detection light passing through the discharge path of the ink droplets without irradiating the ink droplets and outputs a second detection signal in proportion to an amount of the received light;

a determination unit that determines whether or not the detection target nozzle is a defective nozzle incapable of discharging ink droplets based on the first detection signal output from the first light receiving unit when the discharge signal is output from the discharge signal output unit; and a correction unit that corrects a determination result of the determination unit based on the second detection signal output from the second light receiving unit.

2. The image forming apparatus according to claim 1, wherein the correction unit, when the detection target nozzle is determined by the determination unit to be a defective nozzle, compares the second detection signal with a predetermined threshold value and invalidates the determination result of the determination unit when the second detection signal is below or equal to the threshold value.

3. The image forming apparatus according to claim 2, wherein the discharge signal output unit outputs again a discharge signal used to discharge the ink droplets from the detection target nozzle, of which the determination result of the determination unit has been invalidated, and the determination unit determines again whether or not the detection target nozzle is the defective nozzle based on the first detection signal output from the first light receiving unit when the discharge signal is output from the discharge signal output unit again.

4. The image forming apparatus according to claim 2, further comprising:

a cleaning unit that cleans the nozzles; and a print head moving unit that moves the print head between an image forming position at which an image is formed on the recording sheet and a standby position that is a different position from the image forming position, wherein the print head moving unit moves the print head to the standby position when the detection target nozzle is determined to be the defective nozzle by the determination unit in a state in which the print head is located at the image forming position and also when the determination result of the determination unit is validated by the correction unit, and the cleaning unit cleans the defective nozzle of the print head having been moved to the standby position.

5. The image forming apparatus according to claim 1, wherein the second light receiving unit is provided to face the light emitting unit so as to be located on an optical axis of the detection light and constantly outputs the second detection signal while the light emitting unit emits the detection light.

6. The image forming apparatus according to claim 5, further comprising:

a cleaning unit that cleans the nozzles; and a print head moving unit that moves the print head between an image forming position at which an image is formed on the recording sheet and a standby position that is a different position from the image forming position, wherein the print head moving unit moves the print head to the standby position when the detection target nozzle is determined to be the defective nozzle by the determination unit in a state in which the print head is located at the image forming position and also when the determination result of the determination unit is validated by the correction unit, and the cleaning unit cleans the defective nozzle of the print head having been moved to the standby position.

7. A defective nozzle detecting method executed in an image forming apparatus that forms an image on a recording sheet conveyed by a conveying unit by discharging ink droplets from nozzles provided in a print head to the recording sheet, the defective nozzle detecting method comprising:

generating, by using a light emitting unit of the image forming apparatus, detection light that intersects a discharge path of the ink droplets;

outputting, from a discharge signal output unit of the image forming apparatus, a discharge signal used to make the ink droplets discharge from a detection target nozzle being a target for detecting a defective nozzle from among the nozzles;

outputting, when the first receiving unit receives scattered light generated by the ink droplets being irradiated with the detection light, a first detection signal, from a first receiving unit of the image forming apparatus, in proportion to an amount of the received light;

outputting, when the second light receiving unit receives the detection light passing through the discharge path of the ink droplets without irradiating the ink droplets, a second detection signal, from a second light receiving unit of the image forming apparatus, in proportion to an amount of the received light;

determining, by a determination unit of the image forming apparatus, whether or not the detection target nozzle is a defective nozzle incapable of discharging the ink droplets based on the first detection signal output from the first light receiving unit when the discharge signal is output from the discharge signal output unit; and correcting, by a correction unit of the image forming apparatus, a determination result of the determination unit based on the second detection signal output from the second light receiving unit.

* * * * *